US007134884B2

(12) United States Patent
Wang et al.

(10) Patent No.: US 7,134,884 B2
(45) Date of Patent: Nov. 14, 2006

(54) ELECTRICAL CONNECTOR WITH HIGH DURABILITY CYCLES

(75) Inventors: Haiwei Wang, Kunsan (CN); David (Tso-Chin) Ko, Fullerton, CA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/168,598

(22) Filed: Jun. 27, 2005

(65) Prior Publication Data

US 2006/0148332 A1 Jul. 6, 2006

(30) Foreign Application Priority Data

Dec. 30, 2004 (CN) ..... 2004 2 0121279

(51) Int. Cl.
*H01R 12/00* (2006.01)

(52) U.S. Cl. ..... 439/76.1; 439/951

(58) Field of Classification Search ..... 439/59, 439/61, 64, 76.1, 79, 660, 951; 174/255, 174/261; 361/752; 29/830, 832, 842, 876
See application file for complete search history.

(56) References Cited

U.S. PATENT DOCUMENTS 4,487,466 A * 12/1984 Petit et al. ..... 439/222
5,393,250 A * 2/1995 Richardson et al. ..... 439/825
5,436,803 A * 7/1995 Annis et al. ..... 361/818
5,562,487 A * 10/1996 Ii et al. ..... 439/495
6,007,382 A 12/1999 Wu
6,142,802 A * 11/2000 Berg et al. ..... 439/180
6,183,308 B1 * 2/2001 Laity ..... 439/676
6,334,781 B1 * 1/2002 Nishio et al. ..... 439/76.1
6,398,587 B1 6/2002 Chen et al.
6,495,768 B1 * 12/2002 Cho ..... 174/250
6,945,465 B1 * 9/2005 Nishizawa et al. ..... 235/492
2006/0148332 A1 * 7/2006 Wang et al. ..... 439/761

* cited by examiner

*Primary Examiner*—James R. Harvey
(74) *Attorney, Agent, or Firm*—Wei Te Chung

(57) ABSTRACT

An electrical connector (1) comprises a mating cavity (147) defining a front-to-back direction for mating and unmating, a supporting bracket (14) defined in the mating cavity, and a printed circuit board (20), the supporting bracket comprising a front portion (144), the front portion comprises a top surface, the printed circuit board secured to the supporting bracket and comprises a plurality of conductive pads (21, 22, 23) formed thereon, and wherein the top surface of the front portion is higher than the conductive pads of the printed circuit.

19 Claims, 4 Drawing Sheets

ELECTRICAL CONNECTOR WITH HIGH DURABILITY CYCLES

BACKGROUND OF THE INVENTION

1. Field of the Invention

The present invention generally relates to an electrical connector, and more particularly to a Universal Serial Bus Connector with a printed circuit board.

2. Description of Prior Art

Portable electronic devices are found more and more applications in human livings with rapid developments of the science and technology nowadays. A portable electronic device needs to get smaller and smaller on one hand for portability and to incorporate as many electronic components therein as possible on the other hand for functioning. Thus, electronic components accommodated in the portable electronic device and electrical connectors accommodated in the portable electronic device to connect peripheral electronic components, which are not put in the portable electronic device, to the portable electronic device are all made as small as possible.

Universal Serial Bus (USB) connectors are often used to connect peripheral electronic components, such as Hard Disk Drive and CD ROM, to portable electronic devices. A mini USB connector having a small size is widely used in MP3 player. The conventional mini USB connector comprises four contacts for mating with the complementary connector. But, in some specialist, the mini USB needs to mate with the connector having different pin count of contacts. As mentioned above, two different kinds of mini USB connectors are needed for mating with different connectors. Obviously, it increases the cost. A kind of connector has nine contacts is used for solving this problem. But it is difficult to assemble nine contacts on a tiny tongue. Therefore, a printed circuit board has a plurality of conductive pads replacing the tongue has a plurality of contacts.

When the complementary connector inserted into the USB connector having a printed circuit board, the conductive pads of the USB connector is scraped easily.

Hence, it is desirable to have an improved USB connector to overcome the above-mentioned disadvantages of the prior art.

BRIEF SUMMARY OF THE INVENTION

Accordingly, the object of the present invention is to provide a electrical connector with high durability cycles.

In order to achieve the above-mentioned object, an electrical connector comprises a mating cavity defining a front-to-back direction for mating and unmating, a supporting bracket defined in the mating cavity, and a printed circuit board, the supporting bracket comprising a front portion, the front portion comprises a top surface, the printed circuit board secured to the supporting bracket and comprising a plurality of conductive pads formed thereon, and wherein the top surface of the front portion is higher than the conductive pads of the printed circuit.

Other objects, advantages and novel features of the invention will become more apparent from the following detailed description of the present embodiment when taken in conjunction with the accompanying drawings.

DETAILED DESCRIPTION OF THE INVENTION

Figure 1:
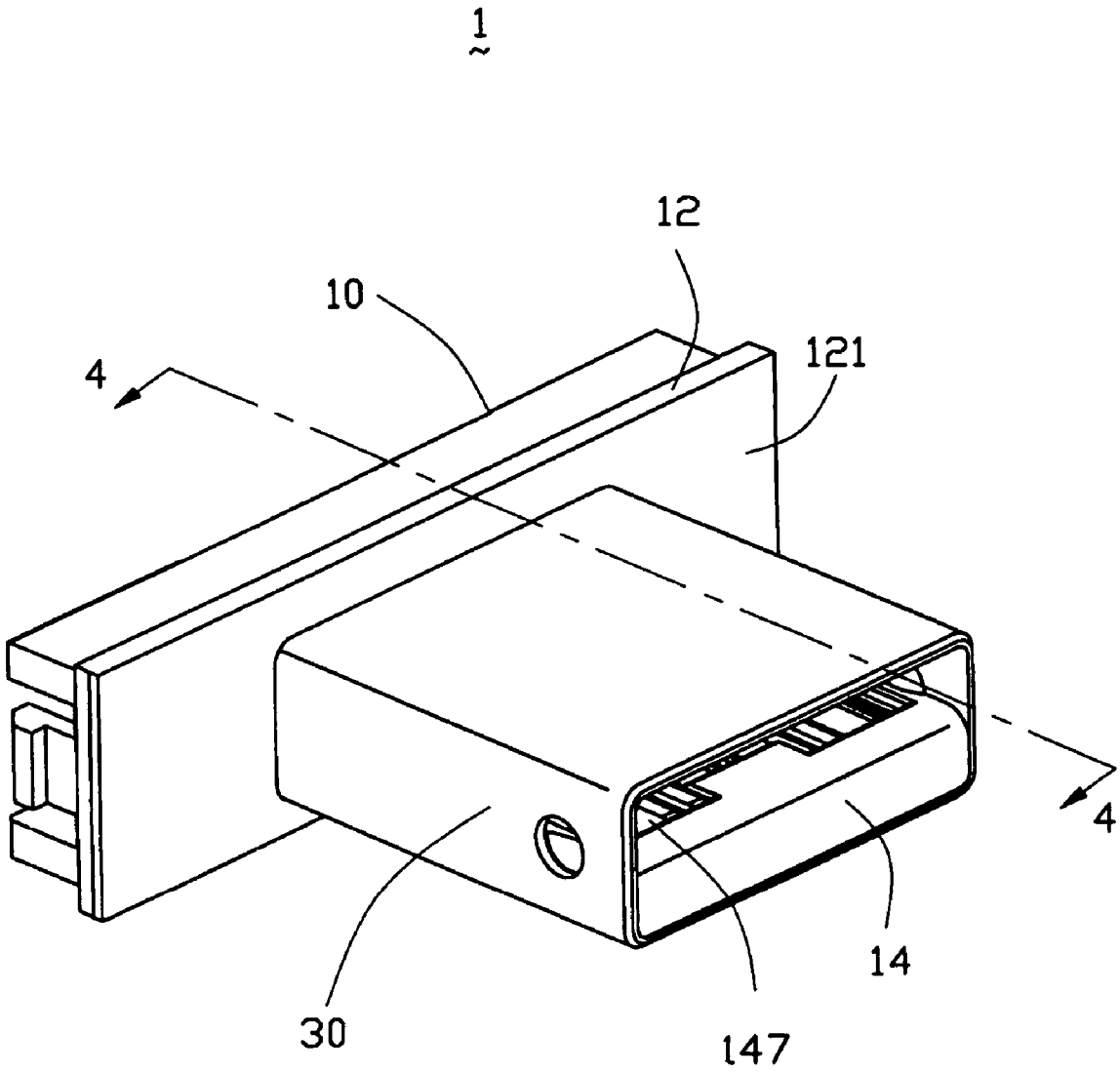
FIG. 1 is a perspective view of an electrical connector in accordance with the present invention.

Reference will now be made to the drawing figures to describe the present invention in detail.

Figure 3:
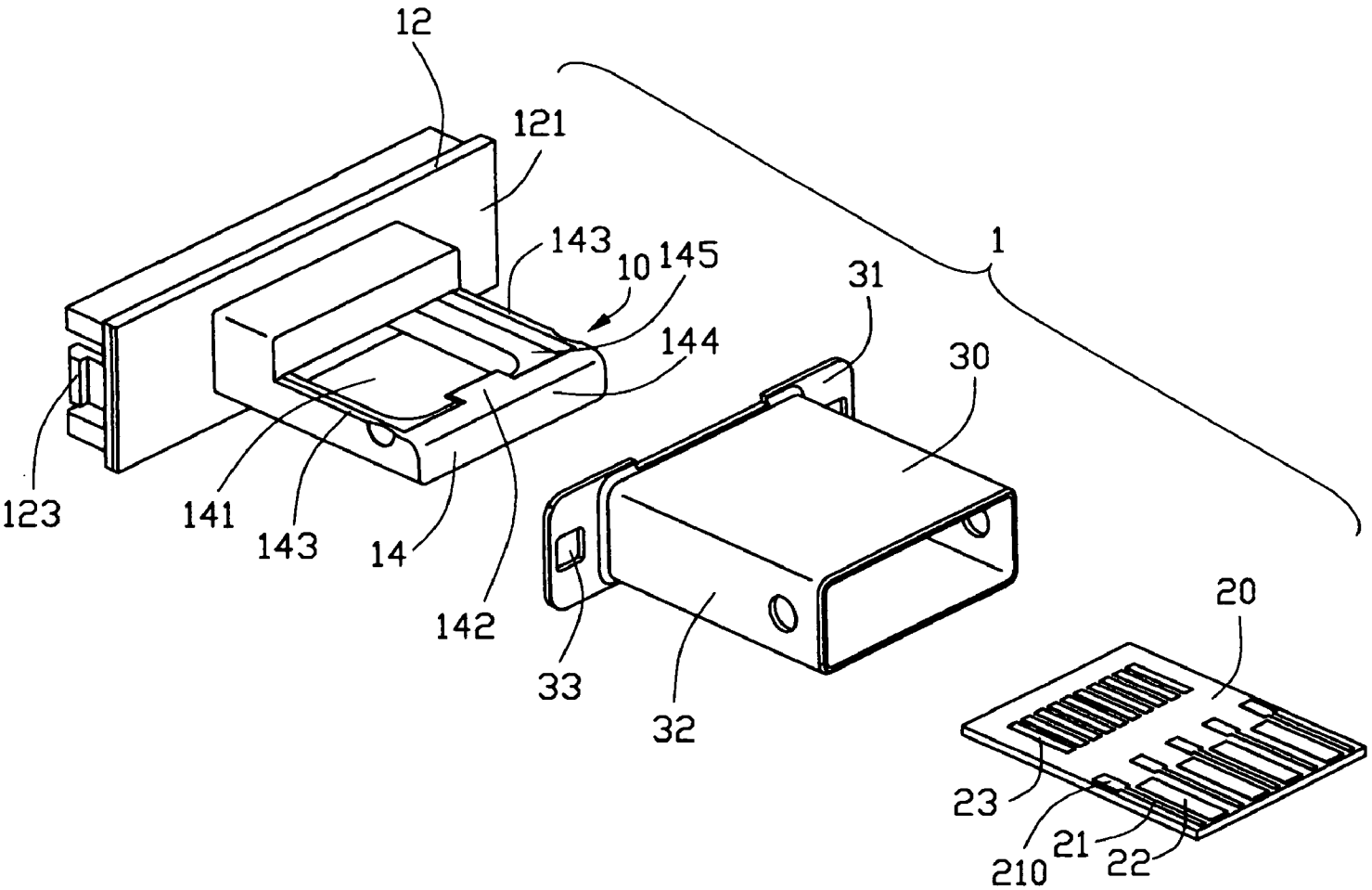
FIG. 3 is an exploded, perspective view of the electrical connector shown in FIG. 1.
Figure 4:
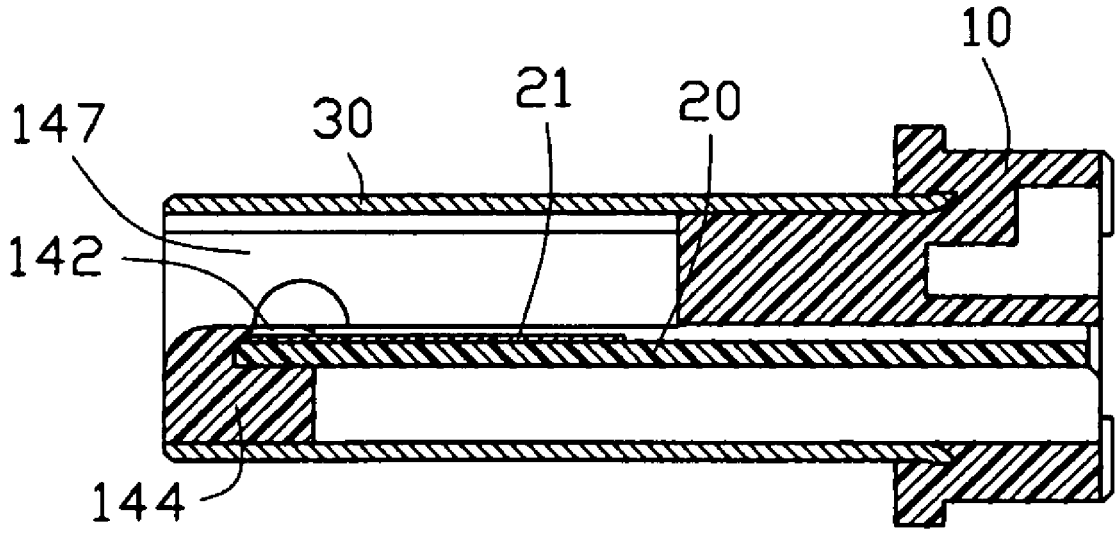
FIG. 4 is a cross-section view taken along line 4–4 of the electrical connector shown in FIG. 1.

Referring to FIGS. 1 and 3, an electrical connector 1 in accordance with the present invention comprises an insulative housing 10, a printed circuit board (PCB) 20 received in the insulative housing 10, and a shell 30 enclosing the insulative housing 10 to commonly form a so-called casing.

Figure 2:
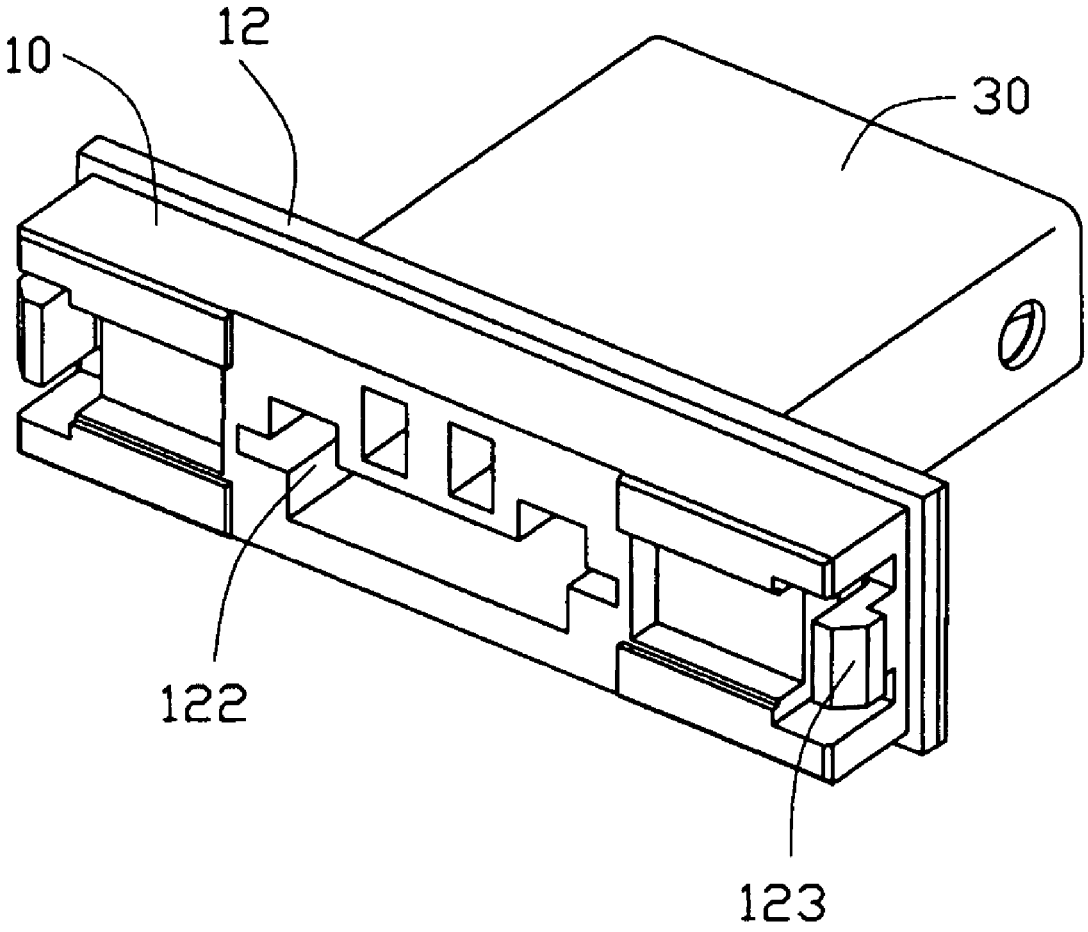
FIG. 2 is a view similar to FIG. 1, but taken from a different aspect.

Joining with FIGS. 2 and 3, the insulative housing 10 comprises a rectangular base portion 12, and a tongue-sharp supporting bracket 14 extending forwardly therefrom. The base portion 12 has a receiving passage 122 extending therethrough along a front-to-back direction. A pair of latches 123 are formed at the lateral ends of the base portion 12, respectively, for engaging with a complementary equipment (not shown). The supporting bracket 14 defines a cutout 141 in a center thereof communicating with the passage 122, a pair of lateral arms 143 and a front portion 144 surrounding the cutout 141. The supporting bracket 14 is partially cut from a top surface thereof to form a supporting portion 145. A guiding portion 142 extends rearwardly from the center of the top surface of a front portion 144.

The shell 30 is seamless and fabricated by deep draw process. The shell 30 comprises a frame portion 32 and a pair of lateral ears 31 extending from the frame portion 32 outwardly. Each lateral ear 31 has a hole 33 thereon.

The PCB 20 forms a plurality of conductive pads thereon. The conductive pads comprise five first conductive pads 21, four second conductive pads 22, and nine third conductive pads 23. The first conductive pads 21 and second conductive pads 22 are disposed alternately along a lateral direction perpendicular to said front-to-back direction. The third conductive pads 23 are positioned at a rear portion of the PCB 20 opposite to the first and second pads 21, 22. The four second conductive pads 22 can be used as a common USB connector. A contact area 210 of the first pads 21 is located behind that of the second pad 22 along said front-to-back direction. The contact area 210 of the first pads 21 essentially is aligned and not dimensionally consistent with a corresponding contact segment thereof along said front-to-back direction and contact area of the second pads 22 is aligned but dimensionally consistent with a corresponding contact segment thereof along said front-to-back direction. The contact area 210 of the first pads is wider than the corresponding contact segment thereof.

During assembly, the lateral ears 31 of the shell 30 are inserted-molded with the base portion 12 of the insulative housing 10, and the frame portion 32 encloses the supporting bracket 14 of the insulative housing 10. The shell 30 and the supporting bracket 14 define a mating cavity 147 along the front-to-back direction for mating and unmating. The holes 33 increase the retaining force between the shell 30 and the insulative housing 10. The PCB 20 is inserted into the passage 122 of the base portion 12 of the insulative housing 10 along a back-to-front direction, and is located above the cutout 141, and is supported by supporting portion of the supporting bracket 14. A front edge of PCB 20 is partially located below 14, thus, the top surface of 14 is higher than the conductive pads 21, 22. The first conductive pad 21 forms a first mating interface for mating with a first connector (not shown), the first and the second conductive pads 21, 22 together form a second mating interface for mating with a second connector (not shown).

When the complementary connector is insert into the mating cavity 147, the contacts of the complementary connector firstly contact with the top surface of the supporting bracket 14, then electrically contact with the corresponding conductive pads 21, 22 on the PCB 20. Thus, the conductive pads 21, 22 can not be broken easily.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a mating cavity defining a front-to-back direction for mating and unmating;

a supporting bracket located in the mating cavity and comprising a front portion, the front portion comprising a top surface;

a printed circuit board secured to the supporting bracket and comprising a plurality of conductive pads formed thereon; and wherein the top surface of the front portion is higher than the conductive pads of the printed circuit;

wherein the front portion of the supporting portion comprises a guiding portion extending backwardly from the center thereof and partially enclosing the conductive pads of the printed circuit board.

2. The electrical connector as claimed in claim 1, further comprising an insulative housing with a base portion, and wherein the supporting bracket extends from the base portion.

3. The electrical connector as claimed in claim 2, wherein the base portion defines a passageway therein for the printed circuit board extending through.

4. The electrical connector as claimed in claim 1, wherein the supporting bracket forms a supporting portion lower than said top face, and wherein the printed circuit board is located on the supporting portion.

5. The electrical connector as claimed in claim 4, wherein the printed circuit comprises a front edge engaging with the front portion.

6. The electrical connector as claimed in claim 1, wherein the conductive pads comprises a plurality of first conductive pads and a plurality of second conductive pads alternately disposed in the mating cavity along a lateral direction perpendicular to said front-to-back direction, and a plurality third conductive pads opposite to the first and second conductive pads along front-to-back direction.

7. The electrical connector as claimed in claim 6, wherein a pitch defined by every adjacent two second pads is essentially same as that of contacts of a Universal Serial Bus (USB) connector.

8. The electrical connector as claimed in claim 6, wherein a contact area of the first contact is located behind that of the second contact along said front-to-back direction.

9. The electrical connector as claimed in claim 8, wherein the contact area of the first pads essentially is aligned and not dimensionally consistent with a corresponding contact segment thereof along said front-to-back direction and contact area of the second pads is aligned but dimensionally consistent with a corresponding contact segment thereof along said front-to-back direction.

10. The electrical connector as claimed in claim 7, wherein the contact area of the first pads is wider than the corresponding contact segment thereof.

11. The electrical connector as claimed in claim 1, wherein said mating cavity is defined by a metallic shell.

12. The electrical connector as claimed in claim 11, wherein the shell is inserted-molded with the insulative housing.

13. An electrical connector, comprising:

a casing with a mating space communicating with an exterior along a front-to-back direction for mating and unmating a complementary connector;

a supporting bracket formed below the mating space and comprising a raised front portion adjacent to a front portion of said mating space; and a printed circuit board disposed in the casing along said front-to-back direction and comprising a plurality of conductive pads formed thereon; and wherein said a front edge of said printed circuit board is at least partially hidden behind the raised front portion in said front-to-back direction for protection during mating;

said bracket further includes a guiding portion extending rearward from a portion of the front portion and the printed circuit board is located thereunder.

14. The electrical connector as claimed in claim 13, wherein the support bracket is a part of the casing.

15. The electrical connector as claimed in claim 14, wherein said bracket is integrally formed with an insulative housing of said casing.

16. The electrical connector as claimed in claim 13, wherein said casing is defined by a metallic shell rather than an insulative housing.

17. The electrical connector as claimed in claim 13, wherein said printed board is secured to the bracket.

18. An electrical connector comprising:

a casing defining a mating space along a front-to-back direction, for mating and unmating with a complementary connector, with a front opening to communicate with an exterior;

a protecting block of said casing located around the front opening of the mating space;

a printed circuit board located below said mating space and comprising a plurality of conductive pads formed thereon; and wherein a front edge of said printed circuit board is at least partially hidden behind the protection block in both the front-to-back direction and a downward vertical direction for protection during mating.

19. The connector as claimed in claim 18, wherein the protection block further defines a guiding portion extending along said front-to-back direction farther than other portions aside.

* * * * *